United States Patent [19]

Suzuki et al.

[11] Patent Number: 4,512,383

[45] Date of Patent: Apr. 23, 1985

[54] DIE CASTING PROCESS AND APPARATUS THEREFOR

[75] Inventors: Shunsuke Suzuki, Tokyo; Masanobu Mori, Yokosuka; Takeshi Miyata, Hamamatsu, all of Japan

[73] Assignee: Nissan Motor Company, Limited, Yokohama, Japan

[21] Appl. No.: 449,649

[22] Filed: Dec. 14, 1982

[30] Foreign Application Priority Data

Jan. 21, 1982 [JP] Japan ..... 57-6753

[51] Int. Cl.[3] ..... B22D 18/02

[52] U.S. Cl. ..... 164/35; 164/65; 164/113; 164/255; 164/312; 164/339

[58] Field of Search ..... 164/113, 119, 120, 254, 164/255, 257, 258, 65, 35, 312, 339

[56] References Cited

U.S. PATENT DOCUMENTS

| | | | |
|---|---|---|---|
| 2,952,056 | 9/1960 | Shuck | 164/258 |
| 3,861,449 | 1/1975 | Barbero | 164/65 |
| 3,955,612 | 5/1976 | Schultheiss | 164/255 |
| 4,008,749 | 2/1977 | Bellocci et al. | 164/119 |
| 4,347,889 | 9/1982 | Komatsu et al. | 164/312 |

FOREIGN PATENT DOCUMENTS

| | | | |
|---|---|---|---|
| 56-47251 | 4/1981 | Japan | 164/113 |
| 201616 | 2/1966 | Sweden | 164/254 |
| 398338 | 1/1973 | U.S.S.R. | 164/254 |
| 522906 | 8/1976 | U.S.S.R. | 164/254 |

*Primary Examiner*—Nicholas P. Godici
*Assistant Examiner*—Maureen Weikert
*Attorney, Agent, or Firm*—Lane, Aitken & Kananen

[57] ABSTRACT

A vertical pressure die casting apparatus comprising a stationary member, an air-permeable die detachably mounted on the stationary member and formed with a cavity including a downwardly open runner portion and a casting cavity portion communicating with the runner portion, a die clamping member to clamp the die vertically between the stationary member and the die clamping member, a sleeve held in position with respect to the stationary member and having a bore upwardly communicating with the runner portion of the cavity in the die, and a power cylinder provided below the die and having a cylinder body fixedly held in position with respect to the stationary member and a piston rod extending upwardly into the sleeve and vertically slidable in the sleeve.

18 Claims, 14 Drawing Figures

DIE CASTING PROCESS AND APPARATUS THEREFOR

FIELD OF THE INVENTION

The present invention relates to a process of die casting a metal and to a vertical pressure die casting apparatus to carry out the process.

SUMMARY OF THE INVENTION

In accordance with one outstanding aspect of the present invention, there is provided a vertical pressure die casting process comprising: preparing an air-permeable die formed with a cavity including a runner portion which is open downwardly and at least one casting cavity portion communicating with the runner portion; melting a metal; pouring the molten metal into a tubular sleeve fixedly held in position with respect to a stationary member and having a vertically extending axial bore; detachably mounting the die on the stationary member so that the the axial bore in the sleeve upwardly communicates with the runner portion of the cavity in the die; clamping the die to the stationary member; injecting the molten metal from the axial bore in the sleeve into the cavity in the die by mechanically applying an upward force to the molten metal in the axial bore in the sleeve toward the runner portion of the cavity in the die; allowing the molten metal to solidify in the cavity in the die; removing the die from the stationary member; and withdrawing the resultant castings out of the cavity in the die.

In accordance with another outstanding aspect of the present invention, there is provided a vertical pressure die casting process comprising: preparing an air-permeable die formed with a cavity including a runner portion which is open downwardly and at least one casting cavity portion communicating with the runner portion; melting a metal; pouring the molten metal into a hollow receptacle of a frangible heat-resistant material closely received in a tubular sleeve fixedly held in position with respect to a stationary member and having a vertically extending axial bore, the receptacle having an upper end open to the runner portion of the cavity in the die and a lower end wall portion; detachably mounting the die on the stationary member so that the the upper end of the receptacle is upwardly open to the runner portion of the cavity in the die; clamping the die to the stationary member; injecting the molten metal into the cavity in the die by mechanically applying an upward force to the molten metal in the receptacle through the lower end wall portion of the receptacle toward the runner portion of the cavity in the die and causing the receptacle to be fractured in the axial bore in the sleeve; allowing the molten metal to solidify in the cavity in the die; removing the die from the stationary member; and withdrawing the resultant castings out of the cavity in the die.

A die casting process as set forth above may further comprise forming a closed chamber enclosing the die after the die is mounted on the stationary member and developing a vacuum in the closed chamber.

The die may be clamped to the stationary member by application of a downward force to the die on the stationary member. In this instance, the downward force may be released from the die while continuing the application of the upward force to the metal in the cavity in the die after the molten metal is injected into the die whereby the die is forcibly removed upwardly from the stationary member or, as an alternative, the application of the upward force may once be interrupted after the molten metal is injected into the cavity in the die for allowing an unsolid portion of the metal to drop from the runner portion of the cavity in the die into the axial bore in the sleeve and, thereafter, said downward force is removed and the above mentioned upward force is for the second time applied to the die for forcibly removing the die upwardly from the stationary member.

In accordance with still another outstanding aspect of the present invention, there is provided a vertical pressure die casting apparatus comprising a stationary member; an air-permeable die detachably mounted on the stationary member and formed with a cavity including a runner portion which is open downwardly and at least one casting cavity portion communicating with the runner portion; die clamping means operative to have the die clamped vertically between the stationary member and the die clamping means; a tubular sleeve fixedly held in position with respect to the stationary member and having an axial bore upwardly communicating with the runner portion of the cavity in the die; and a fluid-operated metal-injection power cylinder provided below the die and having a cylinder body fixedly held in position with respect to the stationary member and a piston rod extending upwardly into the sleeve and vertically slidable in the axial bore in the sleeve. The die casting apparatus as set forth above may further comprise a receptacle of a frangible heat-resistant material such as a ceramic material, the receptacle being closely received in the axial bore in the sleeve and having an upper end open to the runner portion of the cavity in the die and a lower end wall portion, the piston rod of the metal-injection power cylinder being engageable at the uppermost end thereof with the lower face of the lower end wall of the receptacle.

BRIEF DESCRIPTION OF THE DRAWINGS

The drawbacks of a prior-art die casting apparatus and the features and advantages of a process and a vertical pressure die casting apparatus according to the present invention will be more clearly understood from the following description taken in conjunction with the accompanying drawings in which like reference numerals designate similar or corresponding structures, units and members and in which.

DESCRIPTION OF THE PRIOR ART

Figure 1:
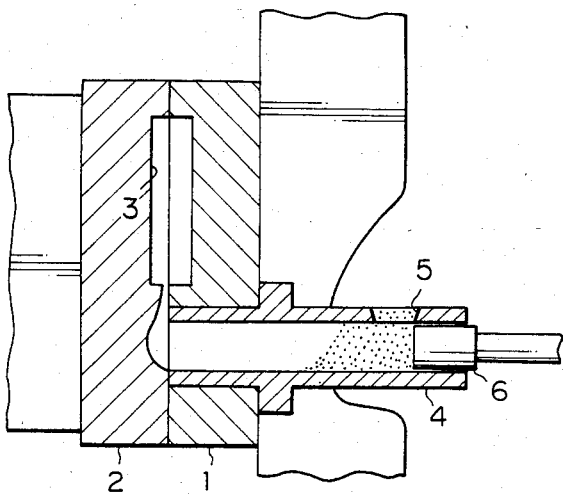
FIG. 1 PRIOR ART
FIG. 1 is a vertical sectional view showing portions of a prior-art die casting apparatus.

Referring to FIG. 1 of the drawings, a prior-art pressure die casting apparatus comprises a stationary die block 1 and a movable die block 2 which is movable into and out of a position contacting the stationary die block 1 and thus forming a cavity 3 therebetween. The movable die block 2 has fitted thereto a tubular injection sleeve 4 formed with a passageway which is open to the cavity 3 and which is formed with a sprue 5. A plunger 6 is axially slidable in the injection sleeve 4 and is connected to suitable drive means (not shown) adapted to drive the plunger 6 for axial movement in the injection sleeve 4. In operation, molten metal is poured into the injection sleeve 4 through the sprue 5 thereof and thereafter the plunger 6 is driven to axially move forwardly or inwardly in the injection sleeve 4 so that the molten metal poured into the injection sleeve 4 is forced into the cavity 3 between the die blocks 1 and 2 which are forcefully clamped together which drives air out between die blocks 1 and 2 from the cavity 3. After the molten metal in the cavity 3 has solidified, the movable die block 2 is driven to move away from the stationary die block 1 so that the casting (not shown) formed in the cavity 3 is withdrawn from the die blocks 1 and 2.

One of the problems encountered in a prior-art pressure die casting apparatus of this nature is that the apparatus is capable of manufacturing only castings that permit the die blocks 1 and 2 to be made to open. Another problem is that a casting manufactured by the apparatus tends to produce cracks due to the solidification shrinkage stress created in the casting since the casting is clamped forcefully between the die blocks 1 and 2 during freezing of the molten metal in the cavity 3. There is also a likelihood that the casting produced may be chilled at the surface thereof and may thus cause reduction of the lifetime of any tools and implements which are to be used for the machining of the casting. Furthermore, the molten metal is injected into the cavity 3 at so high a velocity that air may then be trapped in the metal piece that is cast.

These and other problems encountered in a process using a prior-art pressure die casting apparatus described nature can be avoided in a casting process using an air-permeable mold which is produced by, for example, a lost-wax or investment casting process. An example of such a process is taught in Japanese Patent Publication No. 52-38924 in which an air-permeable mold formed with a vertically elongated riser passage that has a lower end portion submerged in the molten metal in a melting crucible. The mold is accommodated within a mold container connected to a vacuum line through which vacuum is to be developed in the mold container. When a vacuum is thus developed in the mold container, the molten metal in the crucible is sucked into the cavity through the elongated riser passage in the mold. Another example of the casting process using an air-permeable mold is disclosed in Japanese Provisional Patent Publication No. 56-47262. In the casting process proposed therein, an air-permeable mold has its sprue submerged in the molten metal in a melting crucible and a gas pressure is developed over the surface of the molten metal so as to force the molten metal into the mold cavity through the submerged sprue.

In each of these known casting processes, it is important that the air-permeable mold and the associated melting crucible be hermetically sealed up to preclude an escape or leakage of the vacuum or the gas pressure out of the casting apparatus. This results in a disproportionately large and intricate construction of the casting apparatus as a whole. Provision of spacious gates and runners and an elongated riser as required for obtaining sound castings is also responsible for the large size construction of such casting apparatus. If, furthermore, the molten metal fails to be injected into the mold cavity in an adequate period of time with the aid of the vacuum or the gas pressure, improper charging of the mold would result or the molten metal once injected into the mold cavity might flow back into the riser. If, on the contrary, the mold is charged with molten metal excessively long period of time, then the metal being transferred into the mold cavity might solidify in the runner or any passageway intermediate between the sprue and the mold cavity and might create an obstacle to the shot of molten metal during the subsequent cycle of operation. Exacting and active control of the charging period is for these reasons indispensable for carrying out the casting process using an air-permeable mold. Difficulties, however, are encountered in precisely controlling the charging period due to the irregularities resulting from the vacuum or the gas pressure used as the means to transfer the molten metal into the mold cavity. Meticulous control of the temperatures of mold and the molten metal to fill the mold cavity is also essential.

The present invention contemplates provision of a vertical pressure die casting apparatus eliminating all the above described problems that have thus far been inherent in prior-art die casting apparatus of the type described.

It is, accordingly, an important object of the present invention to provide an improved vertical pressure die casting apparatus which is capable of producing castings free from cracks and chilled layers.

It is another important object of the present invention to provide an improved vertical pressure die casting apparatus which uses no such extra devices as those that are required for injecting molten metal into the die cavity by application of a vacuum or a gas pressure to the flow of the molten metal and that will thus result in disproportionately large size construction of the die casting apparatus.

It is another important object of the present invention to provide an improved vertical pressure die casting apparatus which does not necessitate the provision of spacious gates and runners and an elongated riser.

It is another important object of the present invention to provide an improved vertical pressure die casting apparatus with which the material charging period can be controlled with utmost ease.

Finally it is an important object of the present invention to provide an improved vertical pressure die casting apparatus which is capable of manufacturing castings on a quantity production basis and at low cost.

DESCRIPTION OF THE PREFERRED EMBODIMENTS

Figure 2:
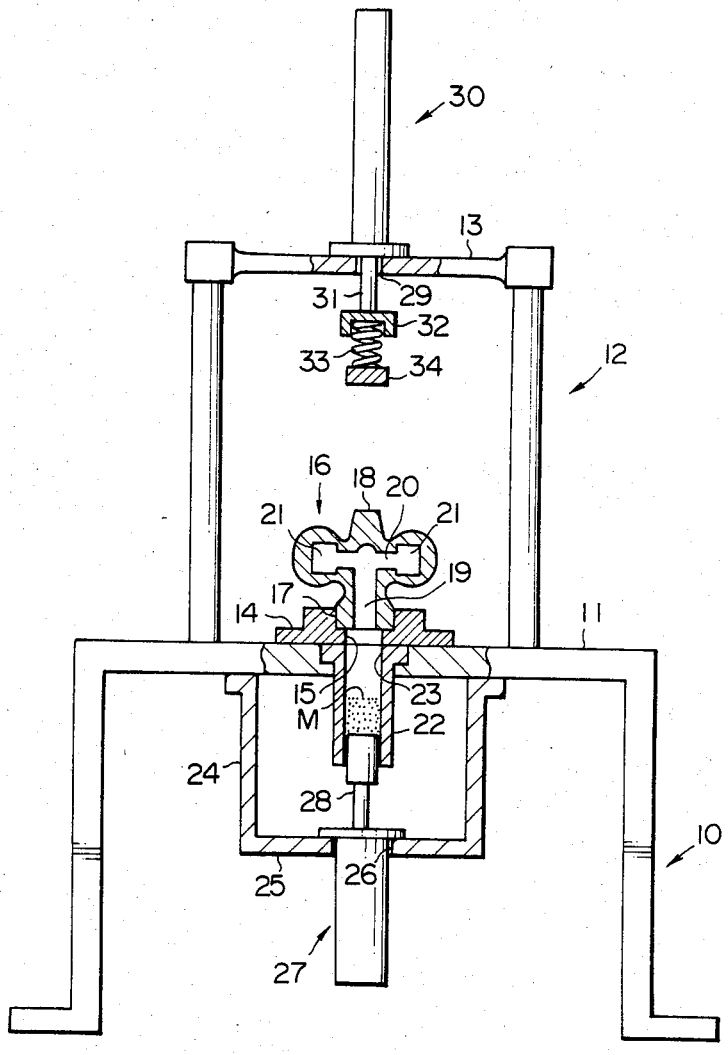
FIG. 2 is a view showing partially in vertical section a first preferred embodiment of a vertical pressure die casting apparatus according to the present invention.

Referring to FIG. 2 of the drawings, a first preferred embodiment of the present invention is shown comprising a lower support frame 10 having a raised flat upper wall portion 11 and an upper support frame 12 fixedly positioned on the wall portion 11 of the lower support frame 10 and also having a raised flat upper wall portion 13. The lower support frame 10 has supported thereon an annular die holder plate 14 securely attached to the upper face of the upper wall portion 11 of the support frame 10. The die holder plate 14 is formed with a central aperture 15 having a vertical center axis. An air-permeable hollow die 16 has a lower end portion 17 detachably fitted into the central aperture 15 in the die holder plate 14 and axially projects upwardly from the die holder plate 14 within the upper support frame 12. The die 16 further has a flat upper end face 18 aligned with the lower end portion 17 and is formed with a cavity which consists of a riser, or vertically extending runner portion 19 which is open at its lower end to the central aperture 15 in the die holder plate 14, a horizontal runner or gate portion 20 emerging out of an upper end portion of the runner portion 19, and a plurality of casting cavity portions 21 arranged around the gate portion 20 and communicating with the runner portion 19 through the gate portion 20. The configuration of the cavity in the die 16 as herein shown and described is simply for the purpose of illustration and is not limitative of the scope of the present invention. The die 16 may be produced by a lost-wax or investment casting process which per se is well known in the art.

The pressure die casting apparatus embodying the present invention further comprises a tubular sleeve 22 which is securely fitted to the upper wall portion 11 of the lower support frame 10 through an opening formed in the wall portion 11 of the support frame 10. The sleeve 22 axially extends downwardly from the upper wall portion 11 of the lower support frame 10 and has an axial bore 23 which is open at its upper end to the central aperture 15 in the die holder plate 14 and which thus communicates through the central aperture 15 with the cavity in the die 16. The central aperture 15 in the die holder plate 14, the runner portion 19 of the cavity in the die 16, and the axial bore 23 in the sleeve 22 are vertically aligned with each other. The sleeve 22 is surrounded by a generally cup-shaped bracket member 24 securely attached to the lower face of the upper wall portion 11 of the lower support frame 10. The bracket member 24 has a lower wall portion 25 downwardly spaced apart from the upper wall portion 11 of the lower support frame 10 and formed with an opening 26 vertically aligned with the axial bore 23 in the sleeve 22. A fluid-operated metal-injection power cylinder 27 has a cylinder body securely connected to the lower wall portion 25 of the bracket member 24 and downwardly extending from the wall portion 25 through the opening 26 in the wall portion 25. The power cylinder 27 further has a piston rod 28 which axially projects from the cylinder body into the axial bore 23 in the sleeve 22 and which is slidable upwardly and downwardly in the bore 23 toward and away from the central aperture 15 in the die holder plate 14. The axial bore 23 in the sleeve 22 is substantially equal in diameter to the central aperture 15 in the die holder plate 14.

The upper wall portion 13 of the upper support frame 12 is positioned above the die 16 on the lower support frame 10 and is formed with an opening 29 which is vertically aligned with the flat upper end face 18 of the die 16. The upper support frame 12 forms part of die clamping means which further comprises a fluid-operated die-clamping power cylinder 30 which has a cylinder body securely connected to and upstanding from the upper wall portion 13 of the support frame 2 and a piston rod 31 which axially projects from the cylinder body downwardly toward the die 16 through the opening 29 in the wall portion 13 and which is movable downwardly and upwardly toward and away from the die 16. The piston rod 31 of the power cylinder 30 has fixedly carried at its lower end a spring seat member 32 having a helical compression spring 33 seated and securely connected at its upper end to the lower face of the seat member 32. The spring 33 is securely connected at its lower end to a die-clamping member 34 having a flat lower face and vertically aligned with the upper end face 18 of the die 16 as shown.

Description will be hereinafter made regarding the mode of operation of the die casting apparatus thus constructed and arranged. Prior to each cycle of operation, the metal-injection power cylinder 27 is maintained in an inoperative condition having its piston rod 28 held in a predetermined lowermost axial position with respect to the sleeve 22 and, likewise, the die-clamping power cylinder 30 is maintained in an inoperative condition having its piston rod 31 held in a predetermined uppermost axial position with respect to the upper support frame 12 as shown. With the metal-injection and die-clamping power cylinders 27 and 30 thus held in the inoperative conditions and further with the die 16 removed from the die holder plate 14, a predetermined volume of molten metal M required for the production of castings in one cycle of operation is poured into the axial bore 23 in the sleeve 22 in a suitable manner. The molten metal M thus poured into the axial bore 23 in the sleeve 22 is collected on the upper end face of the piston rod 28 of the power cylinder 27. The die 16 is then fitted to the die holder plate 14 through the central aperture 15 in the die holder plate 14 and thereafter the die-clamping power cylinder 30 is actuated to drive the piston rod 31 to move downwardly from its uppermost axial position with respect to upper support frame 12. As the piston rod 31 of the power cylinder 30 is thus moved downwardly, the die-clamping member 34 is brought into elastically pressing contact with the upper end face 18 of the die 16 on the die holder plate 14 so that the die 16 is ultimately clamped firmly between the die holder plate 14 and the die-clamping member 34. The metal-injection power cylinder 27 is then actuated to drive the piston rod 28 to move upwardly from its lowermost axial position through the axial bore 23 in the sleeve 22 at a predetermined velocity. As the piston rod 28 of the power cylinder 27 is moved upwardly in the axial bore 23 in the sleeve 22, the molten metal M collected on the upper end face of the piston rod 28 is forced through the central aperture 15 in the die holder plate 14 into the cavity in the die 16 and is distributed through the gate portion 20 into the casting cavity portions 21 of the cavity in the die 16. The molten metal M thus injected into the cavity in the die 16 is frozen for a predetermined period of time and is thus finally solidified. Upon solidification of the molten metal M in the die 16, the die-clamping power cylinder 30 is actuated to drive the piston rod 31 to move upwardly away from the die 16 until the piston rod 31 restores the initial uppermost axial position and as a consequence the die-clamping member 34 is disengaged from the die 16. The die 16 is now removed from the die holder plate 14 and castings (not shown) formed in the die 16 are withdrawn from the cavity in the die 16.

Figure 3:
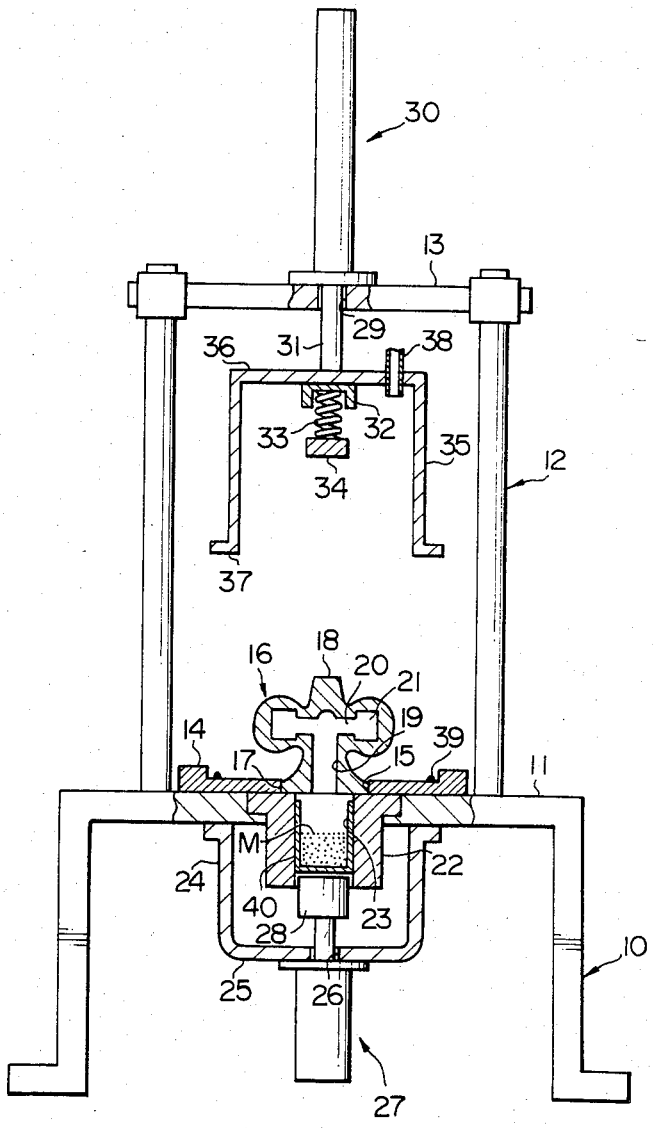
FIG. 3 is a view similar to FIG. 2 but shows a second preferred embodiment of a vertical pressure die casting apparatus according to the present invention.

In FIG. 3 of the drawings is shown a second preferred embodiment of a vertical pressure die casting apparatus according to the present invention. The embodiment herein shown is a modification of the die casting apparatus hereinbefore described with reference to FIG. 2 and comprises, in addition to the members and units constituting the embodiment of FIG. 2, a hollow, cylindrical die enclosure 35 having an upper end wall portion 36 and an open lower end. The upper end wall portion 36 of the die enclosure 35 is securely connected to the piston rod 31 of the die-clamping power cylinder 30 with the spring seat member 32 on the piston rod 31 securely attached to the lower or inner face of the wall portion 36 and accordingly with the spring 33 and the die-clamping member 34 positioned within the die enclosure 35 as shown. The die enclosure 35 further has an annular flange portion 37 along the circumferential lower edge thereof. The die enclosure 35 has an inside diameter larger than the outside diameter of the die 16. A suction conduit 38 projects into the die enclosure 35 through, for example, the upper end wall portion 36 of the enclosure 35 and communicates with a suitable source of vacuum through a valved vacuum passageway, though not shown in the drawings. The die holder plate 14 of the embodiment shown in FIG. 3 is larger in cross sectional area than the die holder plate 14 of the embodiment of FIG. 2 and has an annular sealing element 39 securely attached to the upper face of the die holder plate 14. The sealing element 39 is vertically aligned with the lower edge or the above mentioned flange portion 37 of the die enclosure 35.

The embodiment of FIG. 3 further comprises a hollow, cylindrical receptacle 40 formed of a heat-resistant, frangible material such as a fibrous ceramic material preferably using alumina or asbestos as the fibrous base. The ceramic receptacle 40 is closely received in the axial bore 23 in the sleeve 22 and has a lower end wall portion received on the upper end face of the piston rod 28 of the fluid-operated metal-injection power cylinder 27 and an upper end open directly to the runner portion 19 of the cavity in the die 16.

In operation, a predetermined volume of molten metal M is poured into the receptacle 40 in the axial bore 23 in the sleeve 22 in a suitable manner with the piston rods 28 and 31 of the metal-injection and die-clamping power cylinders 27 and 30 held in the lowermost and uppermost axial positions with respect to the lower and upper support frames 10 and 12, respectively, and further with the die 16 removed from the die holder plate 14 as in the case of the embodiment described with reference to FIG. 2. The molten metal M thus poured into the axial bore 23 in the sleeve 22 is collected in the receptacle 40 received on the upper end face of the piston rod 28 of the power cylinder 27. The die 16 is then fitted to the die holder plate 14 through the central aperture 15 in the die holder plate 14 and thereafter the die-clamping power cylinder 30 is actuated to drive the piston rod 31 to move downwardly from its uppermost axial position with respect to upper support frame 12. As the piston rod 31 of the power cylinder 30 is thus moved downwardly, the die-clamping member 34 is brought into elastically pressing contact with the upper end face 18 of the die 16 on the die holder plate 14 so that the die 16 is ultimately clamped firmly between the die holder plate 14 and the die-clamping member 34. When the die-clamping member 34 is brought into pressing contact with the upper end face 18 of the die 16, the die enclosure 35 carried by the piston rod 31 of the power cylinder 30 has its flange portion 37 brought into pressing contact with the annular sealing element 39 on the die holder plate 14 so that the die 16 is enclosed in a hermetically sealed chamber defined by the die enclosure 35 and the upper face of the die holder plate 14. The valve provided in the passageway interconnecting the suction conduit 38 and the vacuum source is then made open so that air is evacuated from the sealed chamber in the die enclosure 35 and as a consequence a vacuum is developed therein. The metal-injection power cylinder 27 is thereafter actuated to drive the piston rod 28 to move upwardly from its lowermost axial position through the axial bore 23 in the sleeve 22 at a predetermined velocity. As the piston rod 28 of the power cylinder 27 is moved upwardly in the axial bore 23 in the sleeve 22, the molten metal M collected in the receptacle 40 on the upper end face of the piston rod 28 is forced through the central aperture 15 in the die holder plate 14 into the cavity in the die 16 and is distributed through the gate portion 20 into the casting cavity portions 21 of the cavity in the die 16. When the molten metal M is forced into the cavity in the die 16, the receptacle 40 is fractured into fine particles, which are to remain in excess portions of the castings to be produced. The molten metal M thus injected into the cavity in the die 16 is frozen for a predetermined period of time until it has solidified. Upon solidification of the molten metal M in the die 16, the die-clamping power cylinder 30 is actuated to drive the piston rod 31 to move upwardly away from the die 16 until the piston rod 31 is restored to its initial uppermost axial position and as a consequence the die-clamping member 34 is disengaged from the die 16. The die 16 is now removed from the die holder plate 14 and castings (not shown) formed in the die 16 are withdrawn from the cavity in the die 16.

Since the molten metal M is introduced into the die 16 in the vacuumized chamber of the die enclosure 35 in the die 16 of the embodiment hereinbefore described, and gases initially present in the cavity in the die 16 are evacuated therefrom through the perforations in the walls of the die 16 so that the gases will not become entrapped in the molten metal M forced into the casting cavity portions 21 of the cavity in the die 16. The die casting apparatus shown in FIG. 3 is for this reason useful especially for the production of castings of active alloys such as nickel-based super heat-resistant alloys. The receptacle 40 of the ceramic material shown in FIGS. 8–9 serves to prevent the sleeve 22 and the piston rod 28 of the power cylinder 27 from being melted by the heat of the molten metal M poured into the sleeve 22 particularly when such alloys that are mentioned above are to be cast at extraordinarily high temperatures. The sealing element 39 in the embodiment of FIG. 3 is attached to the upper face of the die holder plate 14 but, if desired, may be attached to the lower face of the flange portion 37 of the die enclosure 35 so as to be brought into pressing contact with the upper face of the die holder plate 14 when the die-clamping power cylinder 30 is actuated to cause the piston rod 31 to protrude downwardly. It is apparent that a sealing element may be attached to each of the die holder plate 14 and the flange portion 37 of the die enclosure 35 if further desired.

Figure 4:
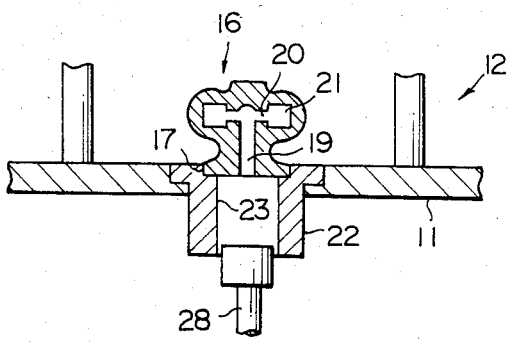
FIG. 4 is a fragmentary vertical sectional view showing portions of a third preferred embodiment of a vertical pressure die casting apparatus according to the present invention.

FIG. 4 of the drawings shows portions of a third preferred embodiment of a vertical pressure die casting apparatus according to the present invention. The embodiment herein shown is also a modification of the embodiment described with reference to FIG. 2 and is characterized in that the die 16 is detachably fitted to the sleeve 22 secured to the upper wall portion 11 of the upper support frame 12. The die holder plate 14 provided in the embodiment of FIG. 2 being thus dispensed with, the axial bore 23 in the sleeve 22 is upwardly open directly to the runner portion 19 of the cavity in the die 16. The arrangement shown in FIG. 4 may also be applied to the embodiment of FIG. 3, in which instance the sealing element 39 forming part of the embodiment of FIG. 3 may be attached either to the upper face of the upper wall portion 11 of the lower support frame 10 or to the lower face of the flange portion 37 of the die enclosure 35 so as to be engageable with the upper face of the wall portion 11 of the lower support frame 10. Alternatively, sealing elements may be attached respectively to both of the wall portion 11 of the lower support frame 10 and the flange portion 37 of the die enclosure 35.

For better understanding of the features and advantages of a vertical pressure die casting apparatus according to the present invention, some examples of the casting process using the die casting apparatus will be hereinafter described.

EXAMPLE 1

An air-permeable die 16 was produced by a lost-wax or investment casting process. In the process of producing the die 16, an arborescent wax pattern was first prepared which consists of a rod-shaped section measuring 20 mm in diameter and 100 mm in length to form the runner portion 19, a cubic section measuring 10 mm×10 mm×10 mm to form the gate portion 20, and a plurality of thin square-shaped sections each measuring 30 mm×30 mm×5 mm to form the casting cavity portions 21 of the cavity in the die 16. The wax pattern was dipped in a refractory slurry, coated with zirconia sand, dipped in the slurry for the second time and further coated with zirconia sand. The resultant mold, having walls of about 10 mm in thickness, was dried at room temperature and was thereafter fired so that the wax pattern was melted and burned out. It may be noted that the runner portion 19 of the cavity in the die 16 thus produced is smaller about 30 percent in cross sectional area than runners to be formed in molds to be produced by a gravity die casting process. The sprue of the mold was formed by an open end portion of the runner portion 19 and was thus sized 20 mm in diameter.

A casting aluminum alloy conforming in composition to JIS AC4C was melted in a smelting furnace. The molten alloy was poured at the temperature of 710° C. into the sleeve 22 of a vertical pressure die casting apparatus contructed as described with reference to FIG. 2, with the piston rods 28 and 31 of the metal-injection and die-clamping power cylinders 27 and 30 held in the downwardly and upwardly retracted positions, respectively. The air-permeable die 16 produced as above described was then fitted to the die holder plate 14 through the central aperture 15 in the die holder plate 14 and thereafter the die-clamping power cylinder 30 was actuated to drive the piston rod 31 to move downwardly from its uppermost axial position with respect to upper support frame 12. The die 16 was thus clamped firmly between the die holder plate 14 and the die-clamping member 34 which was brought into pressing contact with the upper end face 18 of the die 16. The metal-injection power cylinder 27 was then actuated to drive the piston rod 28 to move upwardly from its lowermost axial position through the axial bore 23 in the sleeve 22 at velocities of about 0.05 m/sec to about 1.2 m/sec. As a consequence, the molten metal collected on the upper end face of the piston rod 28 was forced through the central aperture 15 in the die holder plate 14 into the cavity in the die 16 with a pressure of about 5 kgs/cm$^2$ and was distributed through the gate portion 20 into the casting cavity portions 21 of the cavity in the die 16.

Figure 5:
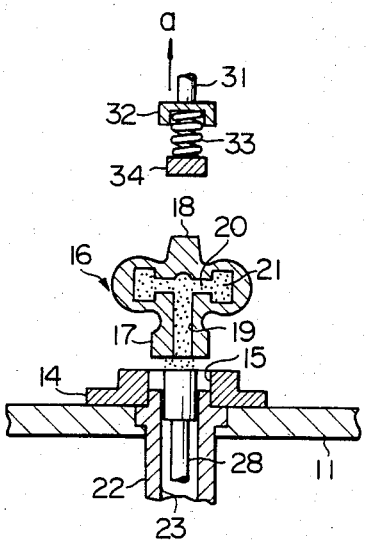
FIG. 5 is a fragmentary sectional view showing portions of the apparatus shown in FIG. 2 at a stage of an example of a die casting process using the particular apparatus.

In about 60 seconds after the molten metal was injected into the cavity in the die 16, the die-clamping power cylinder 30 was actuated to drive the piston rod 31 to move upwardly away from the die 16 as indicated by arrow a in FIG. 5 until the piston rod 31 restores the initial uppermost axial position and as a consequence the die-clamping member 34 was disengaged from the die 16. The metal-injection power cylinder 27 was maintained operative at this stage so that the die 16 was forced out of the central aperture 15 in the die holder plate 14 by the pressure imparted from the piston rod 28 of the power cylinder 27 to the die 16 across an excess portion of the solidified metal formed at the lower end of the runner portion 19 as shown in FIG. 5. The castings formed in the die 16 were withdrawn from the cavity in the die 16 thus removed from the die holder plate 14. After the die 16 was removed from the die holder plate 14, the metal-injection power cylinder 27 was actuated to cause the piston rod 28 to be retracted downwardly into the initial lowermost axial position thereof. The castings thus obtained were excellent in external appearance with no cracks formed therein.

The mechanical strength of the die 16 may be selected depending upon the nature of the molten metal to be put to use but is appropriately selected basically depending upon the desired wall thickness and the chemical composition of the material to be used. The compressive strength of the die 16 used in Example 1 was selected at about 200 kgs/cm$^2$ to about 250 kgs/cm$^2$ and the molten metal was injected under satisfactory conditions by application of the pressure of about 5 kgs/cm$^2$. The injection pressure was selected in consideration of not only the shapes of the castings to be produced but the nature of the alloy used and the temperature of the die 16. It is at any rate important that the injection pressure to be used be selected to be not higher than the mechanical strength of the die 16.

During injection of the molten metal into the die 16, the velocity of movement of the piston rod 28 of the metal-injection power cylinder 27 was varied between about 0.05 m/sec and about 1.2 m/sec as above noted. In this connection it has been observed that the variation in the velocity of movement of the piston rod 28 causes no damage to the die 16 per se but affects the soundness of the resultant castings. When the piston rod 28 is driven for upward movement at a relatively low velocity, the molten metal may fail to properly reach the corners and narrowed portions of the casting cavity portions 21 of the cavity in the die 16. If, on the contrary, the piston rod 28 is driven to move upwardly at a relatively high velocity, then the air which has been present in the cavity in the die 16 does not have time to be completely evacuated from the cavity so that air may be entrapped in the casting to be produced therein.

EXAMPLE 2

An air-permeable die 16 was produced by a lost-wax or investment casting process as in Example 1. A casting aluminum alloy conforming in composition to JIS AC4C was melted in a smelting furnace and was poured at the temperature of 710° C. into the sleeve 22 of a vertical pressure die casting apparatus contructed as described with reference to FIG. 2. The air-permeable die 16 was then fitted to the die holder plate 14 and thereafter the die-clamping power cylinder 30 was actuated to drive the piston rod 31 to move downwardly so that the die 16 was clamped firmly between the die holder plate 14 and the die-clamping member 34. The metal-injection power cylinder 27 was then actuated to drive the piston rod 28 to move upwardly from its lowermost axial position through the axial bore 23 in the sleeve 22 at the constant velocity of about 0.01 m/sec. As a consequence, the molten metal collected on the upper end face of the piston rod 28 was forced through the central aperture 15 in the die holder plate 14 into the cavity in the die 16 with a pressure of about 5 kgs/cm$^2$ and was distributed through the gate portion 20 into the casting cavity portions 21 of the cavity in the die 16.

Figure 6:
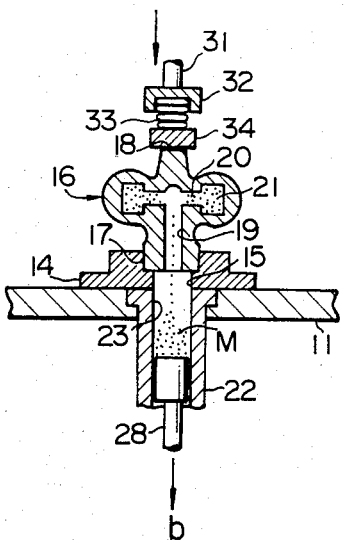
FIGS. 6 and 7 are fragmentary sectional views showing portions of the die casting apparatus shown in FIG. 2 at two different stages of another example of a die casting process using the apparatus of FIG. 2.
Figure 7:
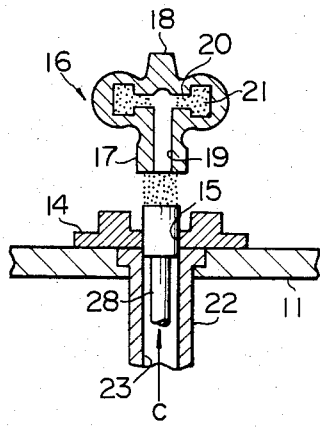

In about 30 seconds after the molten metal was injected into the cavity in the die 16, the metal-injection power cylinder 27 was actuated to drive the piston rod 28 to retract downwardly away from the die 16 as indicated by arrow b in FIG. 6. The result was that the metal remaining unsolid in the runner portion 19 of the cavity in the die 16 was allowed to drop into the sleeve 22. In about 30 seconds thereafter, the die-clamping power cylinder 30 was actuated to drive the piston rod 31 to move upwardly so as to release the die 16 from the die-clamping member 34. The metal-injection power cylinder 27 was for the second time actuated to drive the piston rod 28 to move upwardly through the sleeve 22 as indicated by arrow c in FIG. 7 so that the die 16 was caused to move upwardly above the die holder plate 14 with a small quantity of solidified metal intervening between the piston rod 28 and the lower end portion 17 of the die 16. Castings were withdrawn from the cavity in the die 16 thus removed from the holder plate 14.

The process of Example 2 is characterized in that the metal-injection power cylinder 27 is once operated to drive the piston rod 28 to move downwardly away from the die 16 charged with the molten metal and that the metal remaining unsolid in the runner portion 19 of the cavity in the die 16 is allowed to fall out of the die 16. The molten metal once injected into the cavity in the die 16 is permitted to remain only in the casting cavity portions 21 of the cavity in the die 16 so that the castings respectively produced in the casting cavity portions 21 are separate from each other. For this reason, the castings withdrawn from the die 16 need not be separated from each other so that the steps which would otherwise be required for separating the castings from each other and recovering an excess of material upon completion of the casting process can be dispensed with. Because, furthermore, of the fact that the molten metal is injected into the die 16 solely by the movement of the piston rod 28 of the power cylinder 27, there are invited no such irregularities and errors of timings that are inevitable in a prior-art die casting process in which molten metal is forced into a die with the agency of a vacuum or a gas pressure. If the period of time required for the withdrawal of an unsolid portion of the metal once injected into the cavity in the die 16 is determined in the initial cycle of operation, the metal to be cast can therefore be distributed into the casting cavity portions 21 alone of the cavity in the die 16 in each of the subsequent cycles of operation, provided the operating conditions such as the temperature of the molten metal to be injected into the die 16 and the design of the die 16 used are unchanged.

EXAMPLE 3

Figure 8:
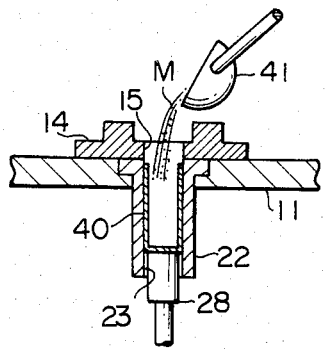
FIG. 8 is a fragmentary sectional view showing portions of the apparatus shown in FIG. 3 at a stage of an example of a die casting process using the particular apparatus.

An air-permeable die 16 was produced by a lost-wax or investment casting process also as in Example 1 and was preheated to the temperature of about 450° C. to about 500° C. Cast iron conforming in composition to JIS FC25 was melted in a smelting furnace and was maintained at the temperature of 1380° C. The molten metal was poured at the temperature of about 1380° C. into the ceramic receptacle 40 of a vertical pressure die casting apparatus constructed as described with reference to FIG. 3 by the use of a small-sized ladle 41 as shown in FIG. 8. The air-permeable die 16 was then fitted to the die holder plate 14 and thereafter the die-clamping power cylinder 30 was actuated to drive the piston rod 31 to move downwardly so that the die 16 was clamped firmly between the die holder plate 14 and the die-clamping member 34. The metal-injection power cylinder 27 was then actuated to drive the piston rod 28 to move upwardly from its lowermost axial position through the axial bore 23 in the sleeve 22 at velocities of about 0.05 m/sec to about 1.2 m/sec. As a consequence, the molten metal collected in the ceramic receptacle 40 on the upper end face of the piston rod 28 was forced into the cavity in the die 16 with a pressure of about 12 kgs/cm$^2$ and was distributed through the gate portion 20 into the casting cavity portions 21 of the cavity in the die 16. In about 80 seconds after the molten metal was injected into the cavity in the die 16, the die-clamping power cylinder 30 was actuated to drive the piston rod 31 to move upwardly away from the die 16 so that the die-clamping member 34 was disengaged from the die 16. The metal-injection power cylinder 27 was maintained operative at this stage so that the die 16 was forced out of the central aperture 15 in the die holder plate 14 by the pressure imparted from the piston rod 28 of the power cylinder 27 to the die 16. The castings produced in the die 16 were withdrawn from the cavity in the die 16 thus removed from the die holder plate 14. The valve intervening between the suction conduit 38 and the vacuum source was kept closed so that the die 16 was maintained in the atmospheric air throughout the above described operation.

When the molten metal was being injected into the cavity in the die 16 during the process of Example 3, the ceramic receptacle 40 was fractured into fine particles as the piston rod 28 of the metal-injection power cylinder 27 was driven to move upwardly toward the die 16. These particles were left in the excess portions of the castings produced. The ceramic receptacle 40 was used to alleviate the temperature drop of the molten cast iron and to protect the sleeve 22 and the piston rod 28 of the power cylinder 27 from the heat of the molten metal. It has further turned out in the process of Example 3 that air may be entrapped in the castings if the piston rod 28 of the metal-injection power cylinder 27 is driven for upward movement at an excessively high velocity although there was observed no objectionable influence on the soundness of the castings when the piston rod 28 was driven to move at the above specified velocity.

In each of the casting processes of Examples 1 to 3 described above, the molten material poured into the sleeve 22 or the ceramic receptacle 40 in the sleeve 22 is injected into the cavity in the die 16 by the pressure mechanically applied to the material by the piston rod 28 of the metal-injection power cylinder 27. Such a process provides prominent advantages over a known gravity die casting process particularly when the runner portion 19 of the cavity in the die 16 has a small cross sectional area. For one thing, the yield of the process can be increased to the order of 70 per cent by weight from the order of 30 per cent by weight in the case of the conventional die casting process. Because, furthermore, of the fact that the molten metal is forced into the die 16 by the fast movement of the piston rod 28 of the metal-injection power cylinder, the injection of the molten metal into the die 16 is completed almost instantaneously so that no such irregularities and errors of timings that are inevitable in a prior-art die casting process using a gas pressure or a vacuum are invited in a process according to the present invention.

Another outstanding advantage achieved by a die casting process according to the present invention is that only such a quantity of molten metal that is required for the production of castings in a single cycle of operation must be poured into the sleeve 22 or the ceramic receptacle 40 so that the metal to be used for each cycle of operation can be melted without use of a large-sized furnace. Furthermore, the furnace to be used need not be sealed off since the molten metal is not injected into the die 16 with a gas pressure developed above the surface of the metal melted in the furnace.

EXAMPLE 4

An air-permeable die 16 was produced by a lost-wax or investment casting process, in which an arborescent wax pattern was first prepared which consists of a rod-shaped section measuring 20 mm in diameter and 100 mm in length to form the runner portion 19, a cubic section measuring 10 mm×10 mm×10 mm to form the gate portion 20, and four thin rectangular sections each measuring 50 mm×60 mm×1.5 mm to form the casting cavity portions 21 of the cavity in the die 16. The wax pattern was dipped in a refractory slurry, coated with refractory sand, dipped in the slurry for the second time and further coated with refractory sand. The resultant mold was fired so that the wax pattern was melted and burned out.

Figure 9:
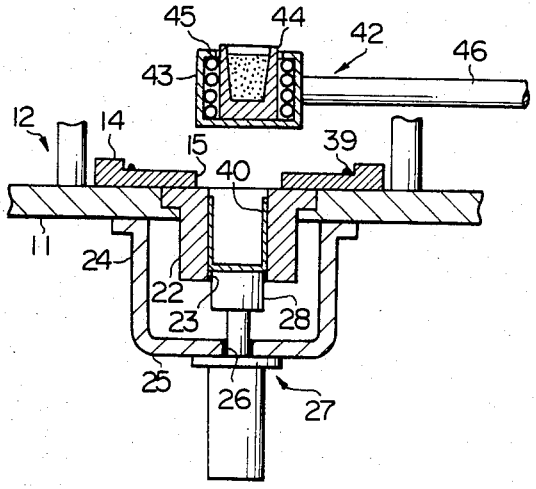
FIGS. 9 to 13 are fragmentary sectional views showing portions of the die casting apparatus shown in FIG. 3 at five different stages of another example of a die casting process using the apparatus of FIG. 3.

A nickel-based heat-resistant alloy was cast in the air-permeable die 16 thus produced. For this purpose, Inconel 713C was melted in a high-frequency induction furnace 42 including a water bath 43, a crucible 44 positioned within the bath 43 and a water-cooled induction coil 45 also positioned within the bath 43 and surrounding the crucible 44 as shown in FIG. 9 of the drawings. The water bath 43 was of the type having a shank 46. The induction coil 45 is connected to a source (not shown) of a high-frequency current. The material was melted in the crucible 44 in a volume required for the production of castings in a single cycle of operation. This is because of the fact that provision of a large-sized smelting furnace equipped with a device to develop a vacuum in the furnace and supply and consumption of a vast amount of electric power would be required if a large volume of molten metal is to be prepared in a limited period of time. When the material was melted in a volume (which may range from about 100 grams to about 10 kilograms) required for the production of castings in only one cycle of operation as in this Example, the material can be completely melted in a sufficiently short period of time and at a proper timing in the course of the casting process. Reducing the period of time for the melting of the material is of significance not only from the standpoint of improving the production efficiency in each cycle of operation but for precluding the deterioration of the constituents of the active metal such as a nickel-based heat-resistant alloy and for inhibiting an ingress of gases into the metal. In the process of this Example, 2 kilograms of Inconel 713C was melted for two minutes in the high-frequency induction furnace 42 by regulating the power to be supplied to the induction coil 45 so that the material, Inconel 713C in the crucible 44 was maintained at 200° C. higher than the melting temperature of the material. The maximum heating capacity of the furnace 42 used was 150 kilowatts.

Figure 14:
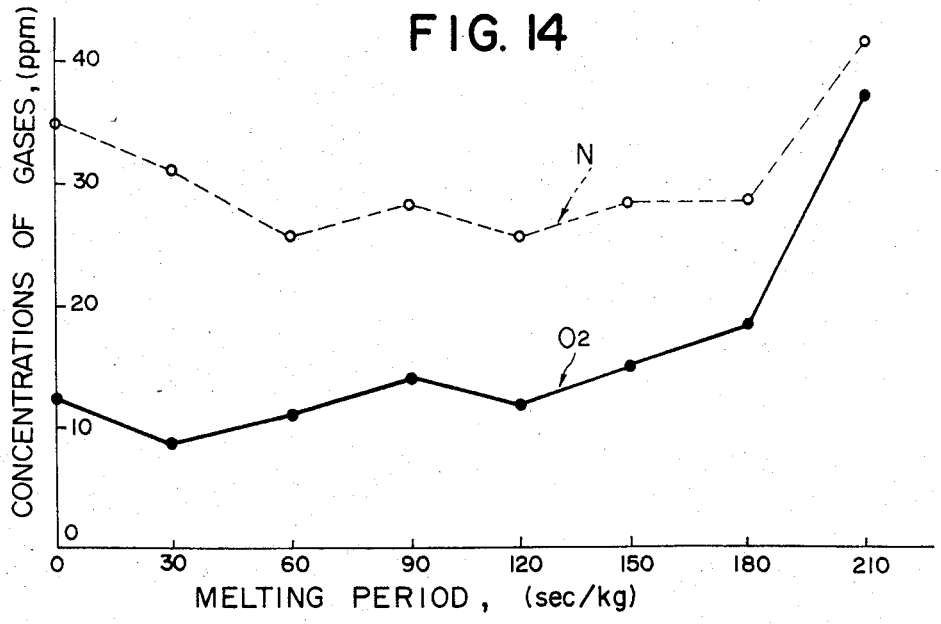
FIG. 14 is a graph showing concentrations of oxygen and nitrogen gases in a molten metal melted for different periods of time by a high-frequency induction process.

FIG. 14 of the drawings shows the results of the experiments conducted to determine the concentrations (in terms of parts per million) of oxygen and nitrogen gases in 1 kilogram of molten Inconel 713C when the material was melted in different periods of time by varying the electric power supplied to the induction coil 44 of the induction furnace 42 shown in FIG. 9. In the graph of FIG. 14, the plot $O_2$ in a full line indicates the concentration in ppm of the oxygen gas and the plot N in a broken line indicates the concentration in ppm of nitrogen gas. As will be seen from these plots a and b, the concentrations of the oxygen and nitrogen gases in the parent metals show practically no increases and the concentration of the nitrogen gas rather shows a decreasing tendency when the metals are melted rapidly for periods of time less than 180 seconds. When the metals are melted for more than 180 seconds, the concentrations of both the oxygen gas and the nitrogen gas show increasing tendencies.

Experiments have further been conducted with specimens of Inconel 713C and GMR 235 in solid states and in states melted for three minutes so as to examine the changes in the proportions of the component elements including active metal elements such as aluminum, titanium and zirconium as caused by the rapid melting of the alloys. The following table shows the results of these experiments.

| | Unit: Percent by weight | | | |
|---|---|---|---|---|
| | Inconel 713 | | GMR 235 | |
| Component Elements | Solid state | Melted for 3 minutes | Solid state | Melted for 3 minutes |
| C | 0.10 | 0.11 | 0.15 | 0.15 |
| Si | 0.09 | 0.09 | 0.39 | 0.34 |
| Mn | 0.04 | 0.03 | 0.25 | 0.22 |
| Cr | 14.27 | 14.28 | 15.46 | 15.40 |
| Ni | * | * | * | * |
| Mo | 4.35 | 4.28 | 5.10 | 4.09 |
| Ti | 0.88 | 0.86 | 1.99 | 1.81 |
| Al | 5.80 | 5.71 | 3.69 | 3.52 |
| Fe | 1.06 | 1.03 | 10.04 | 10.06 |
| B | 0.014 | 0.016 | 0.033 | 0.032 |
| Co | 0.32 | 0.33 | — | — |
| Nb | 2.08 | 2.05 | — | — |
| Zr | 0.10 | 0.08 | — | — |

*Residuals

From the above table it will be understood that the compositions of the specimens tested show substantially no changes caused by the rapid melting of the materials.

Furthermore, melting the metal by high-frequency induction heating as adopted in the process of Example 4 is advantageous in that a large quantity of heat can be applied to the metal in a short period of time. When the metal is to be melted by high-frequency induction heating, it is preferable that the quantity of heat to be applied to the metal per unit time be more than 1.5 cal/gram/sec if the metal is melted in the atmosphere, although the quantity of heat to be applied may vary depending upon the composition and geometry of the alloy. If such a quantity of heat is applied to the metal to be melted, it is preferable to have the metal melted in the high-frequency induction furnace 42 (FIG. 9) for a period of time less than about 180 seconds. When the metal is thus melted in such a short period of time, the active metal is prevented from being contaminated during the melting process.

The metal melted in the high-frequency induction furnace 42 as described above was poured into the ceramic receptacle 40 of the die casting apparatus shown in FIG. 3. The ceramic receptacle 40 was constructed of a fired fibrous ceramic material using alumina ($Al_2O_3$) as the fibrous base but, if desired, may use asbestos as the fibrous base. If molten metal of a temperature higher than 1000° C. is poured directly into the sleeve 22 which was constructed of a tungsten-based alloy, the molten metal begins to solidify as soon as the metal is poured and forms a solid shell on the inner peripheral surface of the sleeve 22. The solid shell thus formed causes obstruction to the molten material to be injected into the die 16 and for this reason not only impedes the injection of the molten metal but will reduce the lifetime of the sleeve 22. These problems can be eliminated by the provision of the ceramic receptacle 40 in the sleeve 22.

Figure 10:
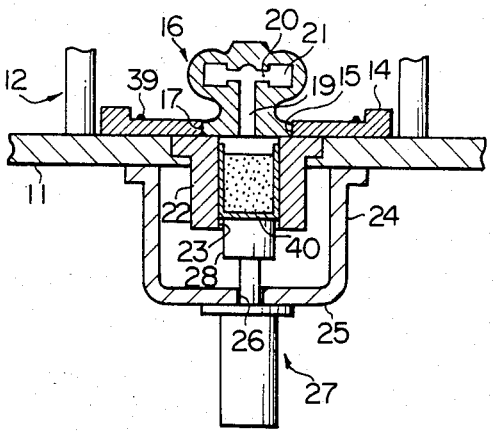
Figure 11:
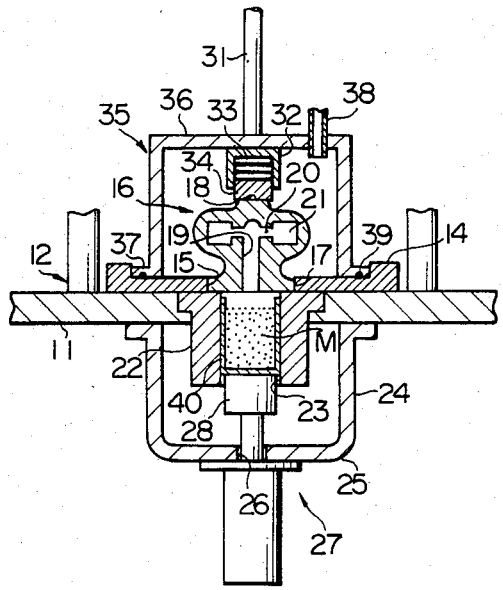
Figure 12:
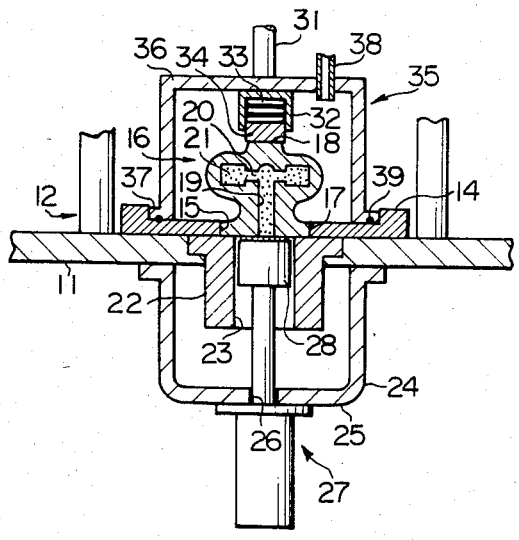

After the molten metal was poured into the ceramic receptacle 40, the air-permeable die 16 which had been produced as described previously was fitted to the die holder plate 14 as shown in FIG. 10 of the drawings. The die-clamping power cylinder 30 was then actuated to drive the piston rod 31 to move downwardly so that the die 16 was clamped firmly between the die holder plate 14 and the die-clamping member 34 and the die enclosure 35 secured to the piston rod 31 had its lower flange portion 37 brought into close contact with the annular sealing element 39 on the die holder plate 14 as shown in FIG. 11. The metal-injection power cylinder 27 was thereafter actuated to drive the piston rod 28 to move upwardly from its lowermost axial position through the axial bore 23 in the sleeve 22 with the result that the molten metal collected in the ceramic receptacle 40 on the upper end face of the piston rod 28 was forced into the cavity in the die 16 as shown in FIG. 12 with a pressure of from about 2 $kgs/cm^2$ to about 5 $kgs/cm^2$ and was distributed through the gate portion 20 into the casting cavity portions 21 of the cavity in the die 16. The injection pressure thus applied to the molten material is represented by the ratio between the thrust produced by the piston rod 28 of the power cylinder 27 and the inside diameter of the sleeve 22 and has an upper limit which is determined depending upon the chemical composition of the material and the shape and the wall thickness of the die 16. The injection pressure further has a lower limit governed by the pressure which is required for completely filling the casting cavity portions 21 of the cavity in the die 16 and which is thus affected by the shapes, sizes and number of the casting cavity portions 21 provided in the die 16. Appropriate consideration will also be required for designing and engineering the die clamping means including the die-clamping power cylinder 30, spring 33 and die-clamping member 34 so that the die 16 can be stably held in position against the injection pressure thus applied to the molten metal to be injected into the die 16. When the molten metal was being injected into the cavity in the die 16, the ceramic receptacle 40 was fractured into fine particles as the piston rod 28 of the metal-injection power cylinder 27 was driven to move upwardly toward the die 16. These particles were left in the excess portions of the castings produced.

While the molten metal is being injected into the cavity in the die 16 as above described, the valve intervening between the suction conduit 38 and the source of vacuum was made open so that the air in the hermetically sealed chamber defined between the die enclosure 35 and the die holder plate 14 and as a consequence a vacuum was developed in the chamber. The source of vacuum used in the process of this Example was a vacuum reservoir in which a vacuum of $10^{-2}$ torr was established and which had the capacity of 100 liters. Developing a vacuum around the air-permeable die 16 is useful for avoiding inclusion of air in the castings to be produced and deterioration of the quality of the castings due to changes in the chemical composition of the material injected into the die 16.

Figure 13:
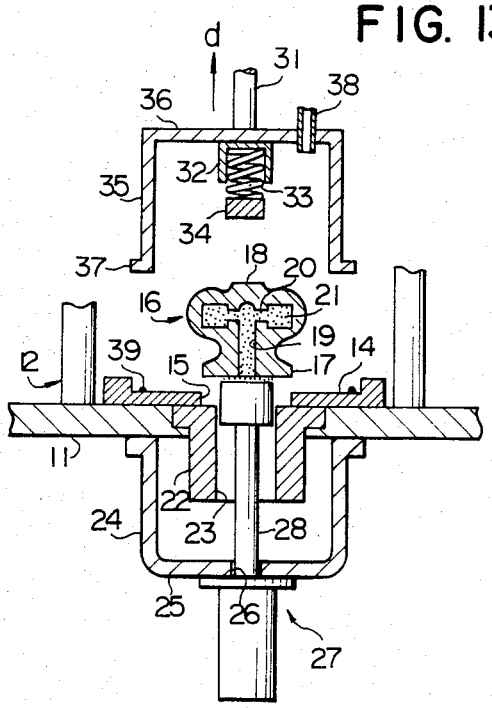

After the molten metal injected into the cavity in the die 16 as described above was solidified, the die-clamping power cylinder 30 was actuated to drive the piston rod 31 to move upwardly away from the die 16 as indicated by arrow d in FIG. 13 so that the die-clamping member 34 was disengaged from the die 16. The metal-injection power cylinder 27 was maintained operative at this stage so that the die 16 was forced out of the central aperture 15 in the die holder plate 14 by the pressure imparted from the piston rod 28 of the power cylinder 27 to the die 16. The castings produced in the die 16 were withdrawn from the cavity in the die 16 thus removed from the die holder plate 14.

If the metal-injection power cylinder 27 is actuated to drive the piston rod 28 to retract downwardly away from the die 16 at a certain point of time when the molten metal injected into the die 16 remains unsolid in the runner portion 19 of the cavity in the die 16 in the process of Example 4, the molten metal in the runner portion 19 of the cavity in the die 16 drops into the sleeve 22 as described in respect of Example 2. In this instance, the molten metal once injected into the cavity in the die 16 is permitted to remain in the casting cavity portions 21 alone of the cavity so that the castings respectively produced in the casting cavity portions 21 are separate from each other and, for this reason, need not be cut from each other after they are withdrawn from the die 16. This contributes to eliminating the steps which would otherwise be required for separating from each other and recovering an excess of material upon completion of the casting process.

The yield of the process of Example 4 was about 84 per cent by weight when an excess material outside the die 16 was not taken into account. When such an excess material was taken into consideration, the yield of the process amounted to about 72 per cent by weight. In the case of a prior-art gravity die casting process, the yield of the process with an excess material taken into account was of the order of 40 per cent by weight when castings similar in shape and size to those produced in the process of Example 4 were produced. This is because of the fact that gates and runners with larger cross sectional areas must be provided in the die to obtain sound products.

As will have been appreciated from the foregoing description, a vertical pressure die casting apparatus and a die casting process according to the present invention have the following advantages:

(1) The castings produced are free from cracks and chilled layers.

(2) No such extra devices that are required for injecting molten metal into the die cavity by application of a vacuum or a gas pressure to the flow of the molten metal and that will thus result in disproportionately large-sized construction of the die casting apparatus as a whole.

(3) Since the molten metal is injected into the die solely by mechanical means, the die can be charged at correct timings so that the irregularities and errors timings which are inevitable in a prior-art die casting process involving application of a vacuum or a gas pressure are not invited.

(4) Spacious gates and runners and an elongated riser need not be provided in the die so that a significantly increased yield of production can be achieved.

What is claimed is:

1. A vertical pressure die casting process comprising:
preparing an air-permeable die formed with a cavity including a runner portion which is open downwardly and at least one casting cavity portion communicating with the runner portion;
melting a metal;
pouring the molten metal into a tubular sleeve fixedly held in position with respect to a stationary member and having a vertically extending axial bore;
detachably mounting said die on said stationary member so that the axial bore in the sleeve upwardly communicates with the runner portion of the cavity in the die;
clamping the die to said stationary member;
injecting the molten metal from the axial bore in the sleeve into the cavity in the die by mechanically applying an upward force to the molten metal in the axial bore in the sleeve toward the runner portion of the cavity in the die;
allowing the molten metal to solidify in the cavity in the die;
removing the die from said stationary member; and
withdrawing the resultant castings out of the cavity in the die,
wherein said die is clamped to said stationary member by application of a downward force to the die on the stationary member and in which said downward force is released from the die while continuing the application of said upward force to the metal in the cavity in the die after the molten metal is injected into the die whereby the die is forcibly removed upwardly from said stationary member.

2. A vertical pressure die casting process comprising:
preparing an air-permeable die formed with a cavity including a runner portion which is open downwardly and at least one casting cavity portion communicating with the runner portion;
melting a metal;
pouring the molten metal into a tubular sleeve fixedly held in position with respect to a stationary member and having a vertically extending axial bore;
detachably mounting said die on said stationary member so that the axial bore in the sleeve upwardly communicates with the runner portion of the cavity in the die;
clamping the die to said stationary member;
injecting the molten metal from the axial bore in the sleeve into the cavity in the die by mechanically applying an upward force to the molten metal in the axial bore in the sleeve toward the runner portion of the cavity in the die;
allowing the motlen metal to solidify in the cavity in the die;
removing the die from said stationary member; and
withdrawing the resultant castings out of the cavity in the die,
wherein said die is clamped to said stationary member by application of a downward force to the die on the stationary member and in which the application of said upward force in once interrupted after the molten metal is injected into the cavity in the die for allowing an unsolid portion of the metal to drop from the runner portion of the cavity in the die into the axial bore in said sleeve and thereafter said upward force is for the second time applied to said die with said downward force released from the die for forcibly removing the die upwardly from said stationary member.

3. A vertical pressure die casting process comprising:
preparing an air-permeable die formed with a cavity including a runner portion which is open downwardly and at least one casting cavity portion communicating with the runner portion;
melting a metal;
pouring the molten metal into a hollow receptacle of a frangible heat-resistant material closely received in a tubular sleeve fixedly held in position with respect to a stationary member and having a vertically extending axial bore, the receptacle having an upper end open to said runner portion of the cavity in the die and a lower end wall portion;
detachably mounting said die on said stationary member so that the upper end of the receptacle is upwardly open to the runner portion of the cavity in the die;
clamping the die to said stationary member;
injecting the molten metal into the cavity in the die by mechanically applying an upward force to the molten metal in the receptacle through said lower end wall portion of the receptacle toward the runner portion of the cavity in the die and causing the receptacle to be fractured in the axial bore in the sleeve;
allowing the molten metal to solidify in the cavity in the die;
removing the die from said stationary member; and
withdrawing the resultant castings out of the cavity in the die;
wherein said die is clamped to said stationary member by application of a downward force to the die on the stationary member and in which said downward force is released from the die while continuing the application of said upward force to the metal in the cavity in the die after the molten metal is injected into the die whereby the die is forcibly removed upwardly from said stationary member.

4. A vertical pressure die casting process comprising:
preparing an air-permeable die formed with a cavity including a runner portion which is open downwardly and at least one casting cavity portion communicating with the runner portion;

melting a metal;

pouring the motlen metal into a hollow receptacle of a frangible heat-resistant material closely received in a tubular sleeve fixedly held in position with respect to a stationary member and having a vertically extending axial bore, the receptacle having an upper end open to said runner portion of the cavity in the die and a lower end wall portion;

detachably mounting said die on said stationary member so that the upper end of the receptacle is upwardly open to the runner portion of the cavity in the die;

clamping the die to said stationary member;

injecting the molten metal into the cavity in the die by mechanically applying an upward force to the molten metal in the receptacle through said lower end wall portion of the receptacle toward the runner portion of the cavity in the die and causing the receptacle to be fractured in the axial bore in the sleeve;

allowing the molten metal to solidify in the cavity in the die;

removing the die from said stationary member; and withdrawing the resultant castings out of the cavity in the die, wherein said die is clamped to said stationary member by application of a downward force to the die on the stationary member and in which the application of said upward force is once interrupted after the molten metal is injected into the cavity in the die for allowing an unsolid portion of the metal to drop from the runner portion of the cavity in the die into the axial bore in said sleeve and thereafter said upward force is for the second time applied to said die with said downward force released from the die for forcibly removing the die upwardly from said stationary member.

5. A vertical pressure die casting process as set forth in claims 1, 2, 3 or 4, further comprising forming a closed chamber enclosing said die after the die is mounted on said stationary member and developing a vacuum in said closed chamber.

6. A vertical pressure die casting process as set forth in claims 1, 2, 3 or 4, in which said die is prepared by a lost-wax die casting process.

7. A vertical pressure die casting process as set forth in claims 1, 2, 3 or 4, in which said metal is melted in the atmosphere by applying heat of at least about 1.5 calories per gram per second to the metal.

8. A vertical pressure die casting process as set forth in claims 1, 2, 3 or 4, in which said metal is melted by a high-frequency induction heating process for a duration less than about 180 seconds.

9. A vertical pressure die casting apparatus comprising:

a stationary member;

an air-permeable die detachably mounted in its entirety on the stationary member and formed with a cavity including a vertically extending runner portion which is open downwardly and at least one casting cavity portion communicating with the runner portion;

die clamping means operative to have the die clamped vertically between said stationary member and the die clamping means;

said die being free to move upwardly away from said stationary member when disengaged from said die clamping means;

a tubular sleeve fixedly held in position with respect to said stationary member and having an axial bore upwardly communicating with said runner portion of the cavity in the die; and a fluid-operated metal-injection power cylinder provided below said die and having a cylinder body fixedly held in position with respect to said stationary member and a piston rod extending upwardly into said sleeve and vertically slidable in the axial bore in the sleeve, said piston rod having at its upper end a cross sectional area larger than the cross sectional area which said runner portion has at its lower open end.

wherein said die clamping means comprises a fluid-operated die-clamping power cylinder provided above said die and having a cylinder body fixedly held in position with respect to said stationary member and a piston rod vertically movable toward and away from the die and a die clamping member which is located below and connected to the piston rod of the die-clamping power cylinder, said clamping member being separate from said die and being engageable with said die at the upper end of the die when the piston rod of the die-clamping power cylinder is driven to protrude downwardly from the cylinder body of the power cylinder.

10. A vertical pressure die casting apparatus as set forth in claim 9, further comprising a receptacle of a frangible heat-resistant material, the receptacle being closely received in the axial bore in said sleeve and having an upper end open to said runner portion of the cavity in the die and a lower end wall portion, the piston rod of said metal-injection power cylinder being engageable at the uppermost end thereof with the lower face of said lower end wall of the receptacle.

11. A vertical pressure die casting apparatus as set forth in claim 10, in which said receptacle is formed of a ceramic material.

12. A vertical pressure die casting apparatus as set forth in claim 10, in which said receptacle is formed of a fibrous ceramic material and includes a fibrous base of aluminum oxide.

13. A vertical pressure die casting apparatus as set forth in claim 10, in which said receptacle is formed of a fibrous ceramic material and includes a fibrous base of asbestos.

14. A vertical pressure die casting apparatus as set forth in any one of claims 9, 10, 11, 12 or 13, further comprising a hollow die enclosure having a lower open end and an upper end wall portion and movable above said die between an upper position raised above said stationary member and a lower position forming a closed chamber defined between the stationary member and the die enclosure and passageway means for providing communication between said closed chamber and a source of vacuum.

15. A vertical pressure die casting apparatus as set forth in claim 14, further comprising a sealing element fixedly attached to said stationary member and vertically aligned with the cross section of the die enclosure at the lower end of the die enclosure, said die enclosure being held in contact with said sealing element along the lower end when held in said lower position thereof with respect to said stationary member.

16. A vertical, pressure die casting apparatus as set forth in claim 14, in which said die clamping means comprises a fluid-operated die-clamping power cylinder provided above said die and having a cylinder body fixedly held in position with respect to said stationary member and a piston rod vertically movable toward and away from the die and a die clamping member which is located below and connected to the piston rod of the die-clamping power cylinder and which is engageable with said die at the upper end of the die when the piston rod of the die-clamping power cylinder is driven to protrude downwardly from the cylinder body of the power cylinder.

17. A vertical pressure die casting apparatus as set forth in claim 16, in which said die clamping means further comprises a compression spring intervening between said die clamping member and the piston rod of said die-clamping power cylinder.

18. A vertical pressure die casting apparatus as set forth in claim 16, in which said die enclosure is securely connected to the piston rod of said die-clamping power cylinder and in which said die clamping member is brought into clamping contact with said die when the die enclosure is held in said lower position thereof with respect to said stationary member.

* * * * *